United States Patent [19]

Schuck et al.

[11] 4,040,261

[45] Aug. 9, 1977

[54] VIBRATORY PLOW

[75] Inventors: Paul R. Schuck, Daven Port; John M. Baylor, Bettendorf, both of Iowa

[73] Assignee: J.I. Case Company, Racine, Wis.

[21] Appl. No.: 648,348

[22] Filed: Jan. 12, 1976

[51] Int. Cl.[2] ..... E02F 5/02; F16L 1/00

[52] U.S. Cl. ..... 61/72.6; 37/193; 37/DIG. 18; 172/40

[58] Field of Search ..... 61/72.6; 37/193, DIG. 18; 172/40

[56] References Cited

U.S. PATENT DOCUMENTS

| | | | |
|---|---|---|---|
| 3,363,423 | 1/1968 | Davis | 61/72.6 |
| 3,502,152 | 3/1970 | Johnson | 61/72.6 |
| 3,604,514 | 9/1971 | Cagne | 172/40 |
| 3,618,237 | 11/1971 | Davis | 37/193 |
| 3,757,869 | 9/1973 | Cagne | 37/DIG. 18 |

*Primary Examiner*—Paul R. Gilliam
*Assistant Examiner*—Alex Grosz
*Attorney, Agent, or Firm*—Cullen, Settle, Sloman & Cantor

[57] ABSTRACT

A vibratory plow particularly suitable for laying cable, pipe and the like underground. The plow blade is pivotally mounted on a frame assembly on a resilient mounting. The frame assembly includes a U-shaped yoke pivotally mounted at opposite ends to the frame assembly. A vibrator is mounted on the yoke and the yoke is pivotally connected to the blade by a link which is pivotally connected at opposed ends to the blade and the yoke. The blade is thereby vibrated in an orbital plowing motion as the blade is drawn through the earth by a suitable vehicle.

14 Claims, 10 Drawing Figures

28
30
54
60
74
76
80
96
98
100
102
105
110
114
116
118
122
124
126
128
130
132
134
136
138
144
146
148
150
152
154
156
158
160
162
164
166
170
172
174
176
180
182
186
190
192
194
196

FIG. 10
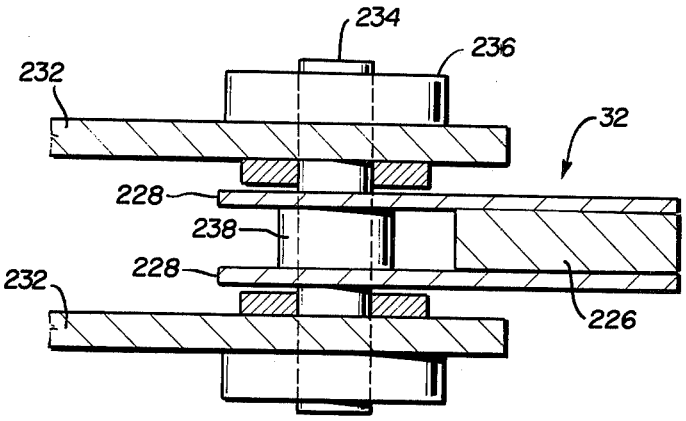
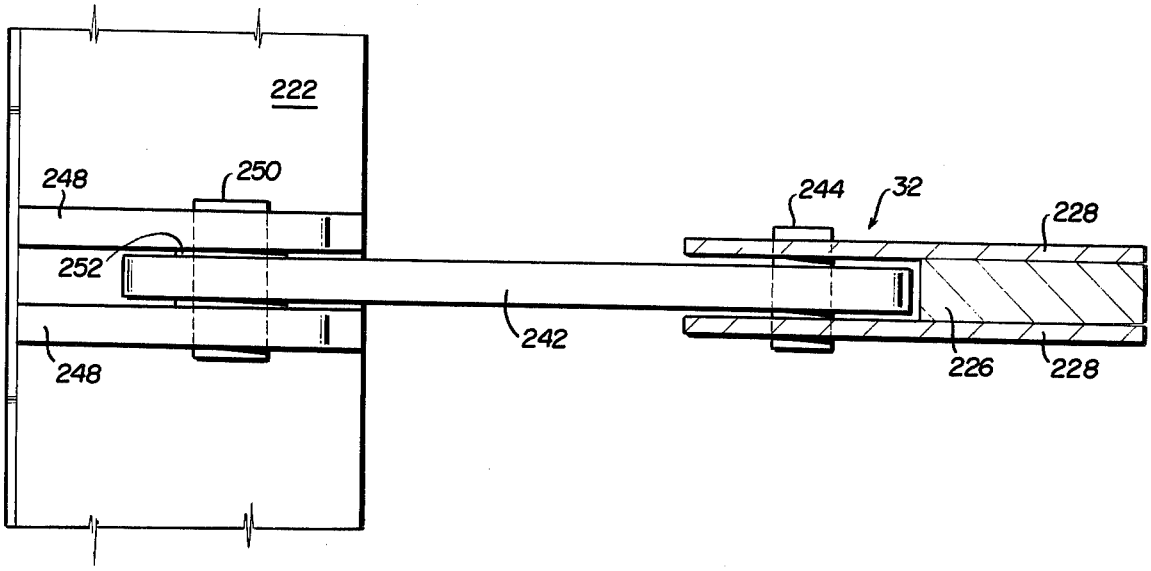
FIG. 9

VIBRATORY PLOW

FIELD OF THE INVENTION

The disclosed invention relates generally to a plow which is vibrated to reduce the drawbar pull. The vibratory plow of this invention may be utilized to lay a continuous length of cable underground at the desired depth. More particularly, this invention relates to a support frame for a vibratory plow which results in an orbital plowing motion of the plow blade and which isolates the vibration from the vehicle.

DESCRIPTION OF THE PRIOR ART

Plows of the type disclosed having an elongated vertical blade have been used for several years to lay cable, flexible pipe, etc. The cable or pipe may either pulled through the cut of the plow blade or a cable chute may be provided on the trailing edge of the blade which guides the cable into the ground from a drum mounted on the prime mover. More recently, various types of vibrators have been mounted on the plow blade or the supporting frame which effectively reduces the drawbar pull or force required to pull the blade through the ground, such as disclosed in U.S. Pat. No. 3,363,423. For this reason, vibration has been utilized in other plow applications, including rippers, etc. Vibration of the blade of cable laying plows has also resulted in other advantages, including less ground disturbence, faster cable laying installation, etc.

Following the development of vibratory cable laying plows, several improvements have been made particularly to isolate vibrations to the plow blade. For example, U.S. Pat. No. 3,618,237 discloses a unique frame support for a cable laying blade having torque cushioning elements which absorb the reciprocable motion of the support and substantially isolate the frame from the supporting structure. initially, it was considered necessary to rigidly mount the vibrator either directly over the blade or perpendicular to the blade to produce substantially vertically vibrations in the blade. The vibrator support of this invention however pivotally suspends the vibrator, preferably on a angle to the plane of the blade, which further isolates the vibrations from the supporting structure, including the prime mover and results in an arcuate cleaving motion in the blade. This blade motion has been found particularly suitable for laying cable, flexible pipe and the like.

SUMMARY OF THE INVENTION

The vibratory plow of this invention includes a prime mover or vehicle, such as a conventional bulldozer, a generally vertical elongated plow blade, a frame assembly which supports the blade on the vehicle and a vibrator or shaker which is preferably supported on the frame assembly. The frame assembly may include elastomeric torque cushioning elements which isolate the vibrations in the frame assembly and plow from the vehicle, as disclosed in U.S. Pat. No. 3,618,237, which is incorporated herein by reference.

In the preferred embodiment of the present invention, a U-shaped yoke is pivotally mounted at opposite ends to the frame assembly and the vibrator is supported on the yoke generally in the plane of the blade. The blade is pivotally mounted on the trailing end of the frame support, with the pivotal connection perferably including elastomeric torque cushioning elements permitting limited pivotal motion of the plow blade. The yoke is pivotally connected to the blade transmitting vibrations from the vibrator or shaker to the blade and resulting in the preferred orbital or arcuate cleaving motion in the plow blade, particularly at the blade tip or distal end.

In the disclosed embodiment, the yoke is connected to the blade by a link which is pivotally connected at one end of the yoke, beneath the vibrator and pivotally connected at the opposite end to the blade, preferably spaced from the pivotal connection of the blade to the frame support. The pivotal connections of the link to the yoke and blade also include resilient elastomeric bearing elements permitting limited pivotal motion of the blade and isolating the blade motion from the support frame. The shaker or vibrator is thus suspended from the frame support with an attachment point to the frame support along the axis of the vibrator, allowing the vibrator to pivot with respect to the frame assembly. The frame is attached by means of a mechanical linkage to the plow blade. The motion of the vibrator or shaker is therefore resisted primarily through the plow blade, which in turn is suspended from the frame assembly at only one point. The entire mechanism therefore functions as a four-bar linkage, with the plow blade as one of the members of the linkage.

The shaker support and linkage thereby further isolates the vibrator from the frame support and results in an arcuate or orbital cleaving motion of the blade, which are the intended purposes of the vibratory plow of this invention.

Other advantages and meritorious features of the present invention will be more fully understood from the following description of the preferred embodiments, the appended claims and the drawings, a brief description of which follows.

BRIEF DESCRIPTION OF THE DRAWINGS

FIG. 9 is a partial cross-sectional bottom view of the linkage shown in FIG. 8, in the direction of view arrows 9—9; and FIG. 10 is a top partially cross-sectional view of the connection between the plow blade and the frame assembly shown in FIG. 8, in the direction of view arrows 10—10.

DESCRIPTION OF THE DRAWINGS AND PREFERRED EMBODIMENTS

Figure 1:
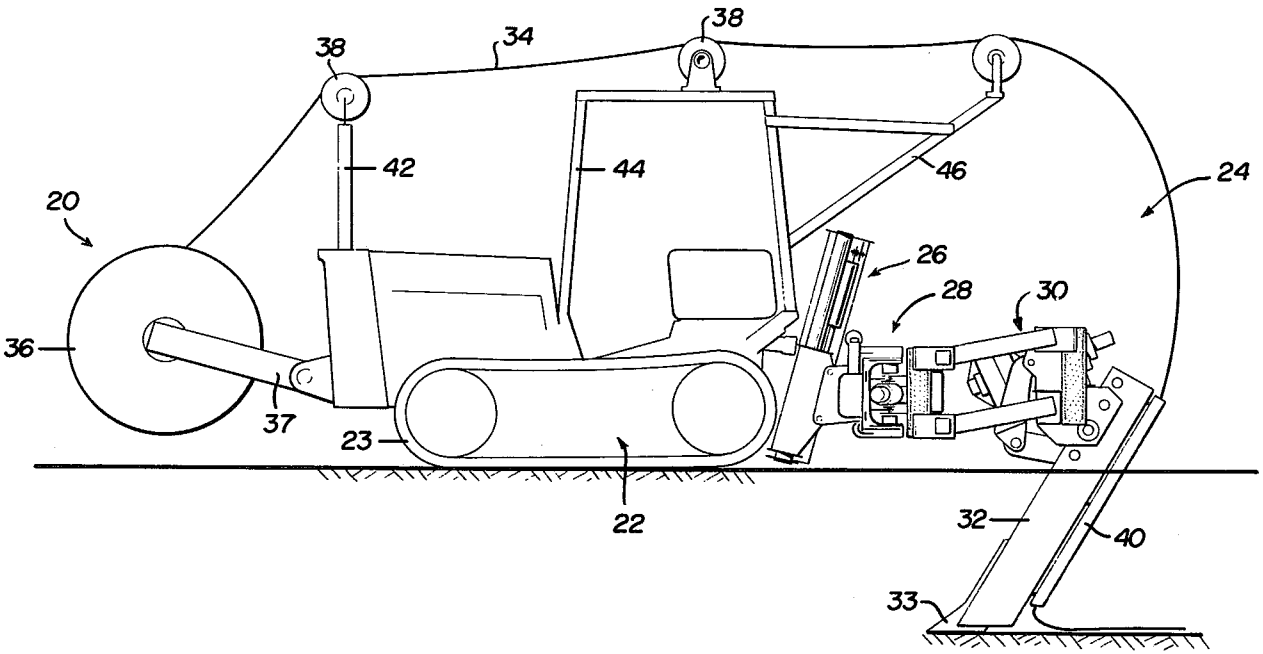
FIG. 1 is a side elevation of one embodiment of a vibratory cable laying plow which includes the present invention.

The embodiment of the cable-laying plow shown in FIG. 1 generally includes a prime mover 22 and a vibratory plow assembly 24. It will be understood that the prime mover may be any suitable vehicle, including bulldozers, tractors and the like. The disclosed embodiment of the prime mover is a conventional bulldozer having a continuous track 23. Generally, the vibratory plow assembly includes a mast assembly 26, an adjustment mechanism 28, a blade support or frame 30 and an elongated blade 32. As described, the mast assembly 26 is adapted to raise, lower and adjust the tilt or cant angle of the blade 32 relative to true vertical. The control mechanism 28 is adapted to adjust the lateral position and angle of the blade 32 relative to the longitudinal axis of the prime mover 22 and the blade support or frame 30 is adapted to vibrate the bulldozer blade and transmit an arcuate or orbital motion to the blade tip or toe 33.

As described above, the cable-laying plow of this invention may be utilized to lay cable, flexible pipe or hose underground. It will be understood that the term cable is used herein as a generic term. In the disclosed embodiment of the cable-laying plow, the cable 34 is received from a drum 36 rotatably supported on a suitable boom 38 of the prime mover 22. The cable is then received on reels 38, over the prime mover and the cable is then fed through a guide or cable chute 40 into the cut made by the plow blade 32. The reels 38 in the disclosed embodiment are supported on a forward mast 42, the bulldozer canopy 44 and a rearward mast assembly 46. The mast assembly 26, control 28 and blade support or frame 30 will now be described in detail.

Figure 2:
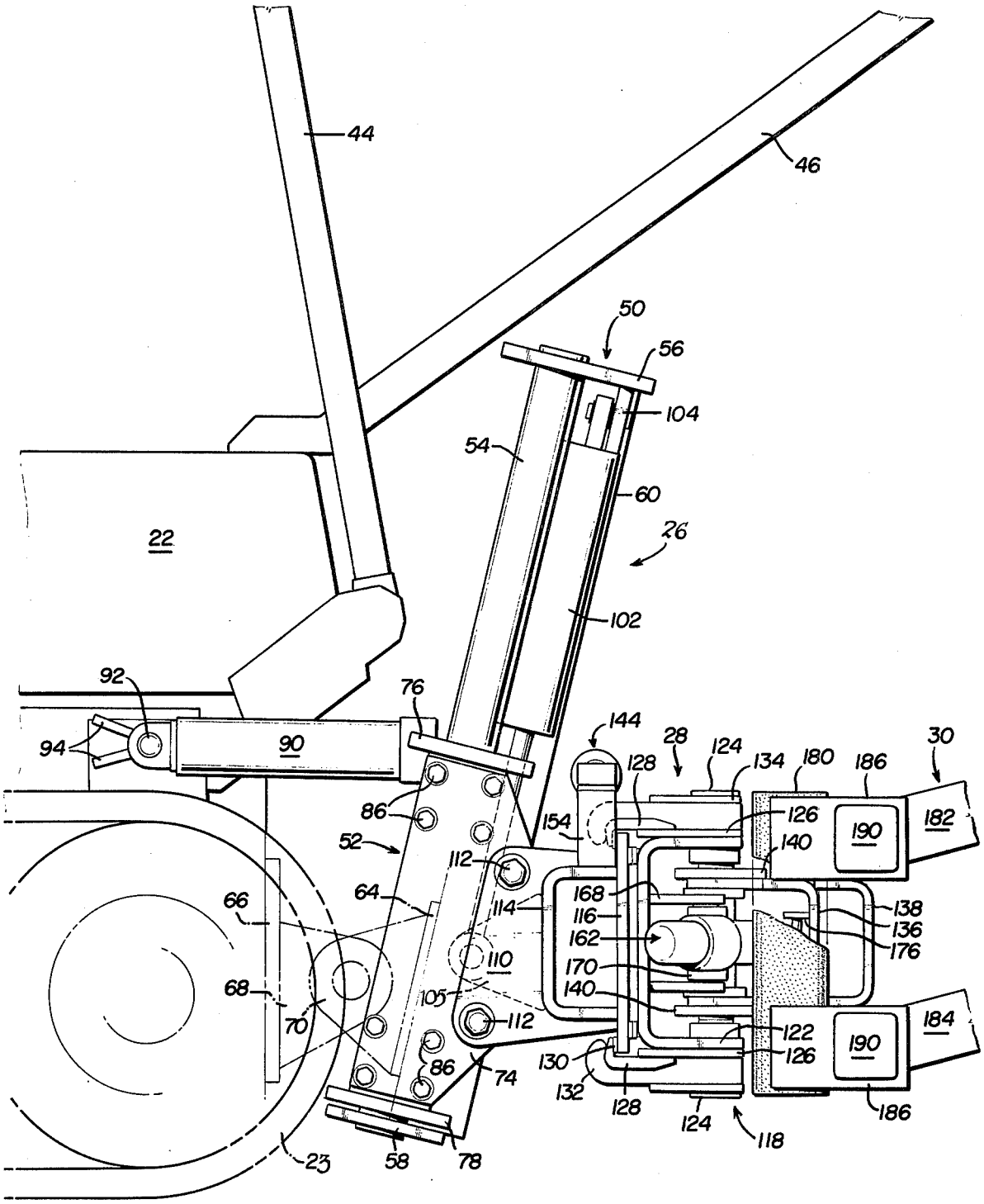
FIG. 2 is an enlarged sided elevation of the mast assembly and control shown in FIG. 1.
Figure 3:
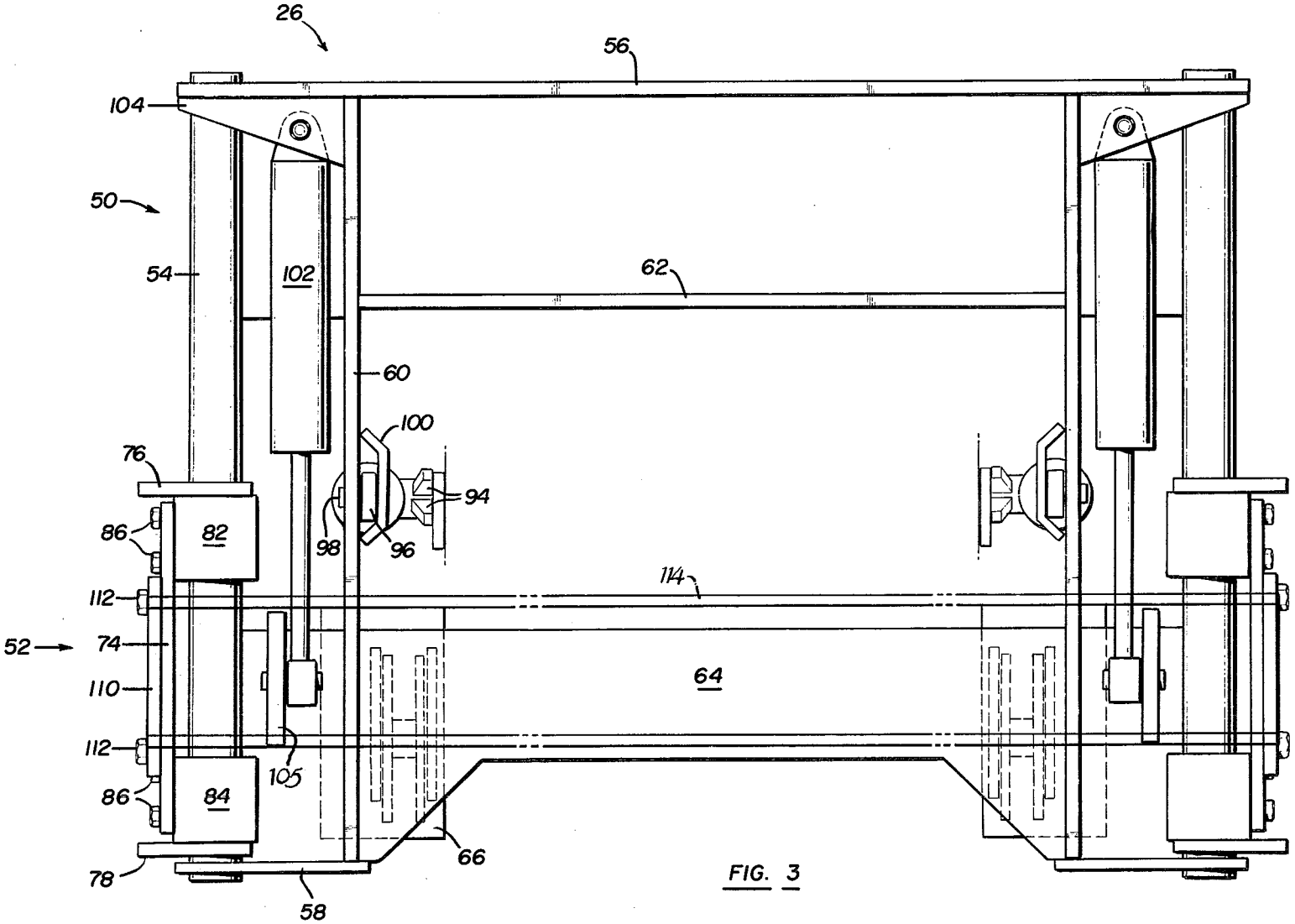
FIG. 3 is a rear elevation of the mast assembly shown in FIGS. 1 and 2.

The mast assembly 26 is shown in detail principally in FIGS. 2 and 3. As shown, the mast assembly 26 generally includes a support frame 50 and a slide frame 52. The support frame includes a pair of generally vertical, laterally spaced, cylindrical rails 54, top and bottom plates 56 and 58, respectively, which secure the rails 54, side plates 60, a reinforcing horizontal plate 62 and a support plate 64. As will be noted, the support and slide frames are formed of a plurality of vertical and horizontal plates, which are preferably steel plates welded together to form a solid supporting structure for the blade. The support frame is pivotally mounted on the prime mover as shown in FIG. 2. The bulldozer includes a plate 66 secured to the bulldozer frame between the tracks 23. A lug 68 is secured to the plate 66 and a mating lug 70 is secured to the support plate 64 of the support frame 50. A suitable bearing or pin is provided between the lugs 68 and 70 to pivotally support the support frame on the prime mover.

Figures 4, 5:
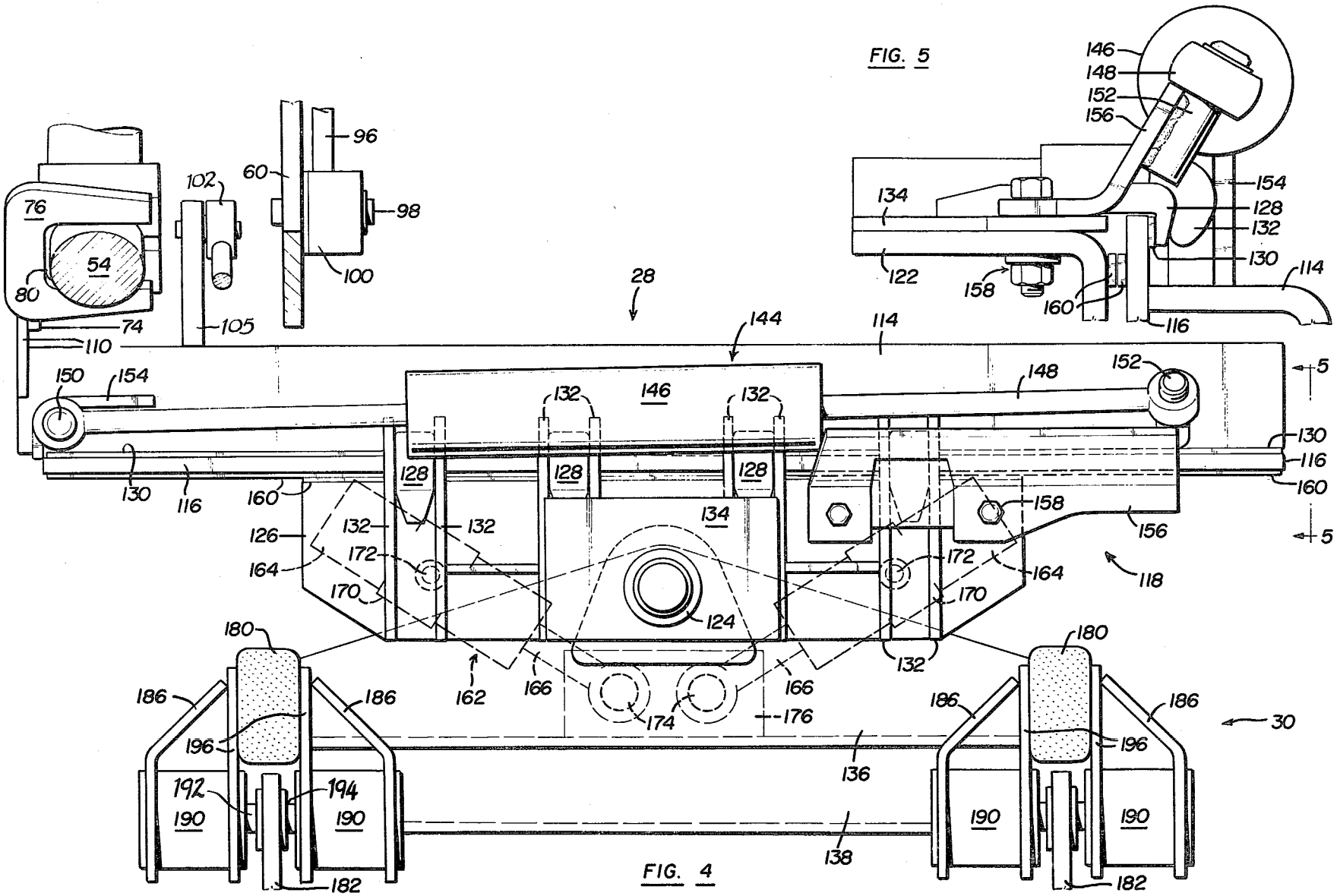
FIG. 4 is a partial top elevation of the side and angle adjustment mechanism disclosed in FIGS. 1 and 2.
FIG. 5 is a partial side view of FIG. 4 in the direction of view arrows 5—5.

The slide frame 52 includes opposed end plates 74, top and bottom collar plates 76 and 78, respectively, having suitable bearings 80 as shown in FIG. 4 and top and bottom box supports 82 and 84, as shown in FIG. 3. The box supports in the disclosed embodiments are bolted by suitable bolts 86 to the end plates 74 and the collar plates 76 and 78 may be welded to the box supports.

The tilting, raising and lowering of the mast assembly is accomplished in the disclosed embodiment by remotely controlled double-acting hydraulic cylinders or pistons. It will be understood, that various power means may be utilized. For example, the slide frame 52 may be raised and lowered by a rack and pinion assembly, however, the preferred embodiment includes hydraulic cylinders because of the ease of control and durability of pistons in field applications. In the disclosed embodiment, the tilt adjustment is accomplished by hydraulic pistons 90 which are pivotally mounted on the prime mover by pin 92 on boss 94, as shown in FIG. 2. The extensible piston rods 96 are pivotally secured to the support frame as shown in FIGS. 3 and 4. A pin 98 extends through the upright or vertical plates 60 and clamp plates 100 are provided between the piston rod and the vertical plates. Extension and retraction of pistons 90 thereby adjusts the tilt angle of the mast assembly 26 and thereby the tilt angle of the plow blade, as further described hereinbelow.

The support frame is similarly raised and lowered by double-acting hydraulic pistons 102, which are supported on plates 104 welded to top plate 56. The opposed end of the pistons 102 are pivotally connected to plates 105 of slidable frame member 52. The slide frame member 52 may thus be raised and lowered by retraction and extension of cylinders 102. As described hereinbelow, raising and lowering of slide plate 52 also raises and lowers the plow blade 32.

As described above, the angular and lateral adjustment of blade 32 is accomplished by control mechanism 28. This control is best shown in FIGS. 2, 4 and 5. The control mechanism is supported on the end plates 74 of slide frame 52. Vertical support plates 110 are bolted by bolts 112 to end plates 74 as shown in FIG. 2. The support plates 110 are welded to support channel 114, which structure supports the control mechanism 28 and the tractor plow assembly. The top and bottom edges of vertical plate 116, which is welded to channel 114, form horizontal rails for laterial shifting of the blade assembly. Plates 110 and 116 and channel 114 are referred to herein as the relatively fixed frame assembly and 118 refers to the slide frame assembly.

The slide frame assembly includes a main support channel 122 which is supported on a central cylindrical pivot 124. Plates 126 are bolted to the top and bottom of channel 122, for supporting hook-shaped elements 128 which are slidably received on the top and bottom edge of plate 116. In the disclosed embodiment, bearing strips 130 are disposed between the hook-shaped elements 128 and the plate 116. Plates 132 are welded to support plates 126, adding lateral strength to hook-shaped elements 128. End plates 134 are welded to the top surface of plates 132, providing a box-shaped support structure. Rearwardly extending channels 136 and 138 support the blade frame assembly 30, as described hereinbelow.

In the disclosed embodiment, the blade assembly is shifted laterally by a fluid actuated hydraulic piston 144 having a cylinder 146 and piston rod 148. One rod end is connected to pin 150 of the relatively fixed frame assembly and the opposed rod is connected to pin 152 of the slide frame assembly. Support plate or standard 154 retains the rod 150 to channel 114 of the fixed frame assembly and bracket 156 retains the pin 152 to the slide frame assembly, as shown in FIG. 5. In the disclosed embodiment, the bracket is secured to the slide frame assembly by bolts 158 and bearing strips 160 are provided between the support plate 116 and channel 122.

The blade assembly may be angularly adjusted about pivot 124 by actuation of hydraulic pistons 162 having cylinders 164 and pistons rods 166 as shown in FIG. 4. Cylinders 164 are pivotally supported within main channel 122 by opposed plates 168, which may be welded to the channel as shown in FIG. 2. The cylinders are received in collars 170 which are supported by pins 172 between the plates 168 as shown in FIG. 4. The piston rods are pivotally connected by pins 174 to horizontal plate 176, which plate forms a part of the frame assembly 30 and which is pivotally supported on vertical pivot 124 as shown in FIG. 4.

Actuation of the pistons 162, by extension of one piston rod and retraction of the opposed piston rod, will therefore result in rotation of the blade frame assembly 30 about vertical pivot 124, providing angle adjustment for the blade assembly.

Figure 6:
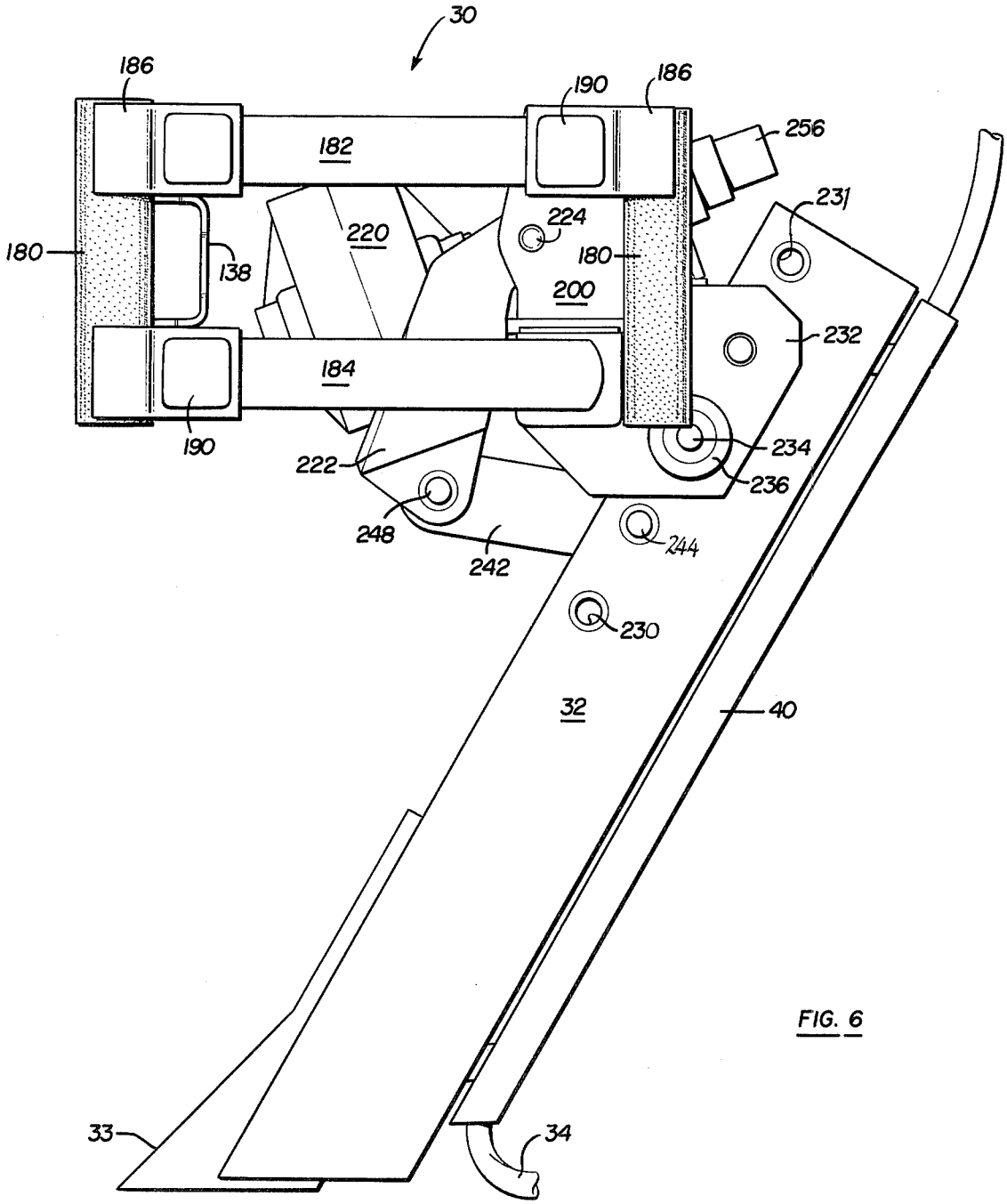
FIG. 6 is an enlarged side elevation of the plow blade and the supporting frame shown in FIG. 1.

The improved frame assembly 30 is shown in FIGS. 6 to 10. As shown in FIG. 6, the frame assembly is supported on channel 138. The frame assembly includes a parallelogram linkage having elastomeric support cushioning elements as described in the above referenced U.S. Pat. No. 3,618,237, which is incorporated herein by reference.

Figure 7:
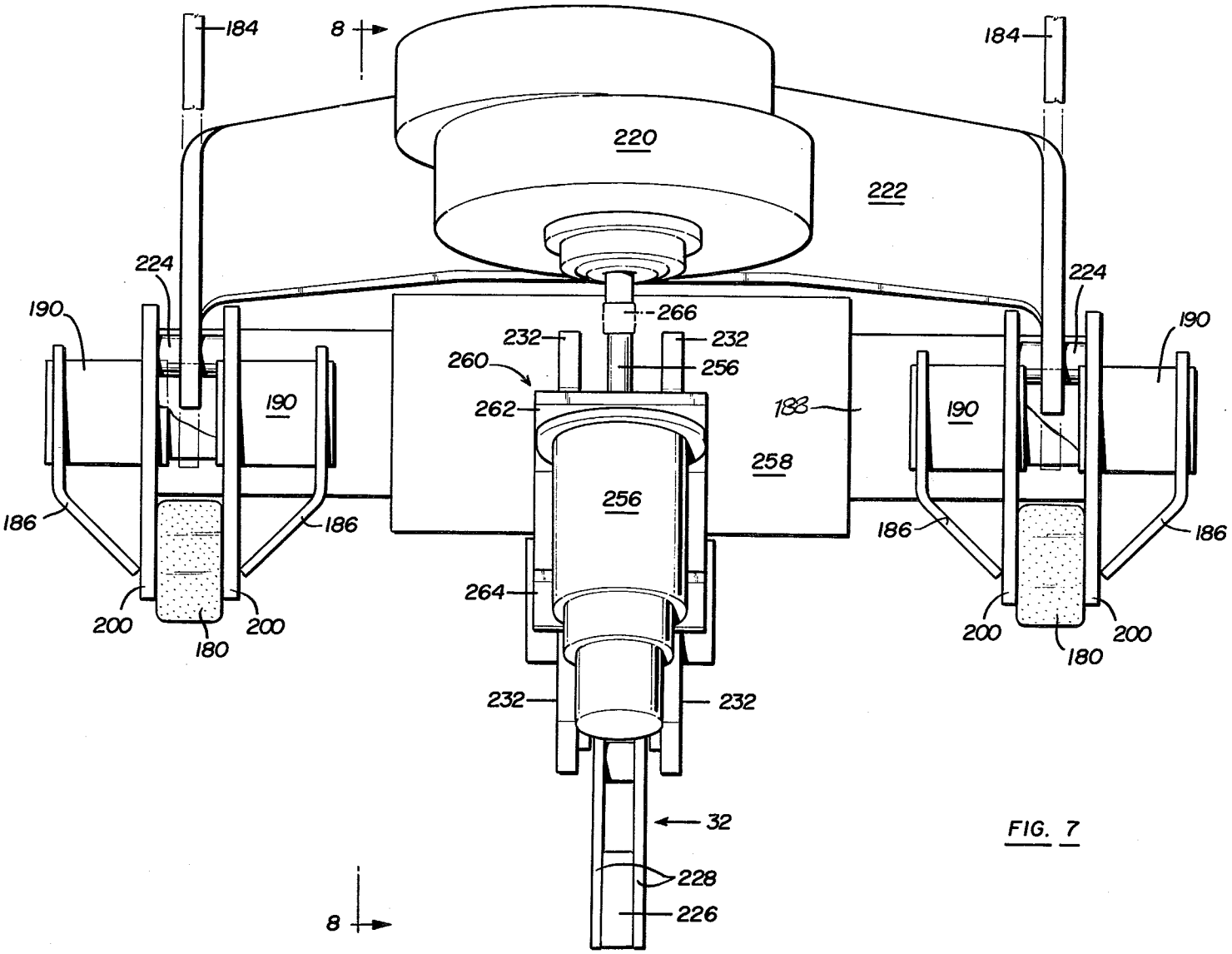
FIG. 7 is a partial top assembly of the blade and support frame shown in FIG. 6.
Figure 8:
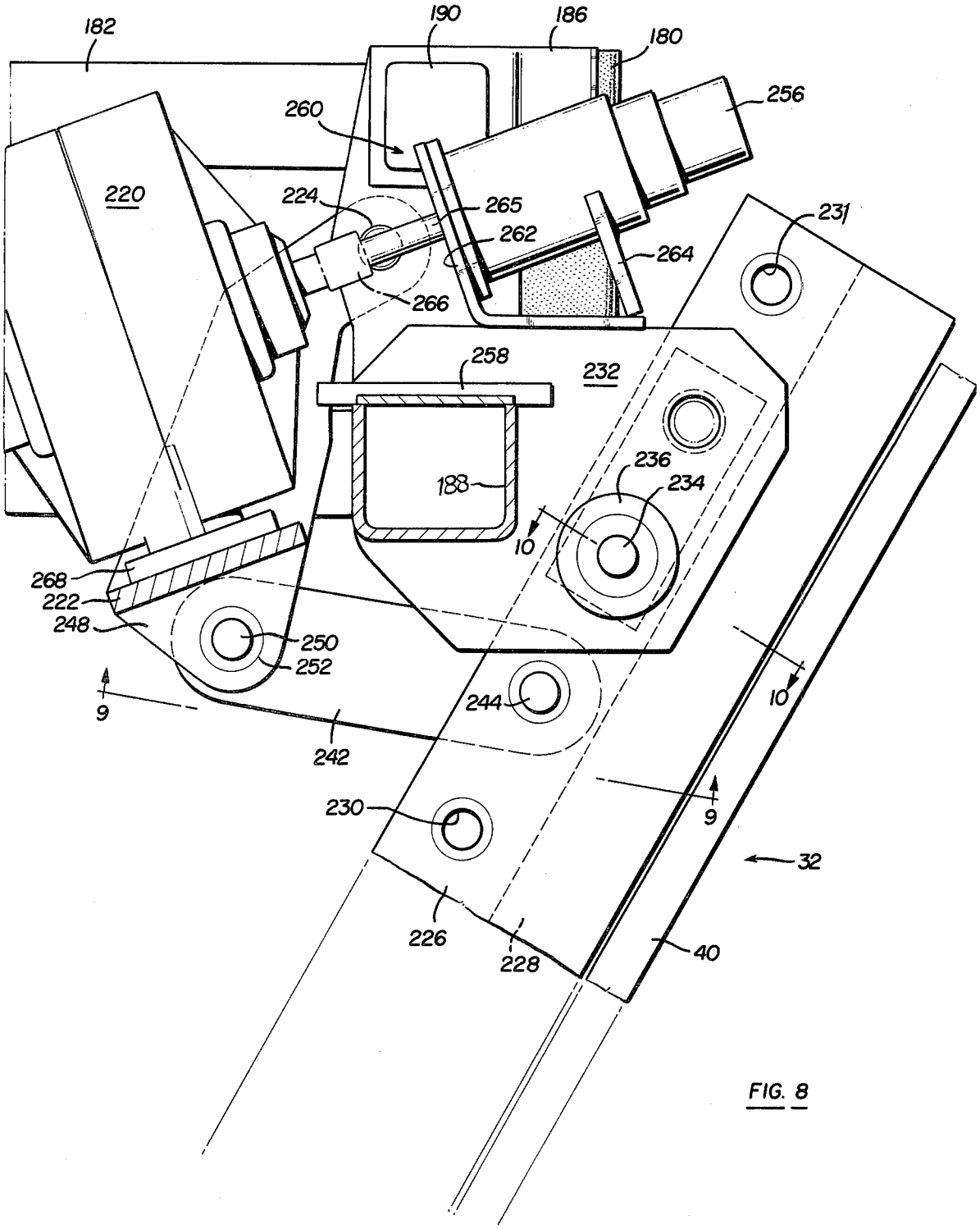
FIG. 8 is a cross-sectional side view of the plow blade and support frame shown in FIG. 7, in the direction of view arrows 8—8.

The parallelogram linkage includes four vertical columns 180, upper side plates 182, lower side plates 184 and a support beam 188 shown in FIGS. 7 and 8. End plates 186 are secured to the side plates by elastomeric torque cushioning elements 190, which elements are rectangular as shown in FIG. 6. The side plates 182 are secured to vertical columns 180 adjacent control mechanism 128 by pins 192 having resilient bushings 194, as shown in FIG. 4. Opposed plates 196 may be welded to vertical columns 180, which plates are secured to torque cushioning elments 190, as shown in FIG. 4 and described in the above-referenced patent. Similarly, support plates 200 may be welded to the rearward vertical columns 180, which plates are supported on torque cushioning elements 190, as shown in FIG. 7. Other details of the parallelogram linkage of the blade support frame may be found in the above-referenced United States patent. This application, however, discloses a unique support for the vibrator and plow blade, which results in orbital or arcuate vibratory motion of the blade, as described hereinbelow.

The vibrator 220 in the preferred embodiment is mounted on a pivotally supported yoke 222. The yoke is supported on plates 200, which in turn are supported on vertical columns 180 as by welding the plates to the columns, as shown in FIG. 7. The opposed ends of the yoke are pivotally supported on pins 224 which may include resilient elastomeric bearing elements. The blade in the preferred embodiment is also pivotally supported on frame 30, as best shown in FIGS. 8 and 10. The blade assembly 32 includes a vertical rigid blade 226, cover plates 228 and toe 33, as shown in FIGS. 6 and 10. The blade is pivotally supported on plates 232 by transverse pivot pin 234. Resilient elastomeric bearing elements 236 are received in plates 232. Alternatively, the bushing 238 between the plates 228 may include a resilient center bushing. The end plates 228 are welded to the blade 226. The yoke 222 is pivotally connected to the blade assembly by link 242, as shown in FIGS. 8 and 9. Link 242 is pivotally connected to the blade by pin 244 which extends between cover plates 228. Integral lugs 248 are connected to the yoke 222, generally in the axis of the vibrator. The integral lugs are pivotally connected to link 242 by pin 250.

The vibrator 220 is therefore supported on a four-bar linkage, including link 242, yoke 222, the frame assembly and the blade 32. Vibrations are thus transmitted from the yoke 222, through link 242, to the blade, and the blade is resiliently and pivotally supported on plate 232. The resilient elastomeric bearing 236 permits limited longitudinal movmement of the blade and pivotal movement about pin 234, resulting in arcuate or orbital motion of the blade in the ground. This motion may be modified for soil conditions by moving the pivotal connection of the link to the blade. In the disclosed embodiment, pivot pin 244 may be moved to the lower blade aperture 230. The blade may also be shifted downwardly for deep soil penetration, using blade aperture 231.

The vibrator or shaker 220 is driven by a suitable motor 256 which is mounted on bracket 260. The bracket may be welded or otherwise secured to plates 232, which plate is welded or otherwise secured on plate 258 and beam 188. The disclosed bracket includes support plates 262 and 264 and the shaft 265 of the motor is connected through universal coupling 266 to the shaker or vibrator. The vibrator 220 may be secured by any suitable means to the yoke 222. In the disclosed embodiment, a suitable mounting plate 268 is provided on the vibrator which is mounted to the yoke.

The disclosed vibrator or shaker 220 is a conventional doubleweight vibrator having eccentric weights mounted on a central shaft. The weights are timed to produce vibrations in any preferred axis or plane. The vibrator will normally be timed to produce vibrations perpendicular to the plane of the plate 268, producing the desired orbital motion in the blade 32. One suitable vibrator is sold commercially by Ajax Flexible Coupling Co., of Westfield, New York, and disclosed in U.S. Pat. Nos. 1,999,213, 2,097,347 and 2,178,813. The motor may be a conventional hydrostatic fixed displacement motor available from various sources. As disclosed, the general assembly of the various frame elements is composed of a plurality of plates, channels and the like, which may be formed of any suitable material, including conventional structural steel.

The operation of the disclosed vibratory cable-laying plow may be fully understood from the above description of the various figures however, the following is a brief description of the overall operation. First, the blade assembly 32 may be raised, lowered and tilted by operation of the mast assembly 26, best shown in FIGS. 2 and 3. As will be understood from the description above, the support frame 50 is pivotally supported on plate 66 of the prime mover or vehicle 22. The slide frame assembly 52 is slidably supported on rails 54 which are part of the support frame assembly. The blade assembly 32 is supported on the slide frame assembly as best shown in FIG. 1. Actuation of pistons 102 raises and lowers the slide frame assembly 52 and therefore the blade assembly 32. Actuation of pistons 90 adjust the tilt angle of the mast assembly 26 relative to true vertical, thereby adjusting the tilt angle of the blade assembly. The piston rod 96 of piston 90 may be extended to increase the downward thrust at the rear of the plow blade; forward tilting, resulting from retraction of the piston rod, provides additional lift height of the blade and additional clearance during transport of the vibratory plow. Rearwardly tilt of the mast assembly also causes the blade to travel slightly to rearward if the plow is raised through use of the vertical lift mechanism. This action is advantageous in that there is less tendency for additional cable to be drawn through the chute or guide 40 as the plow blade is raised, thereby reducing cable damage. Similarly, reverse bending of the cable may be held to a minimum by adjusting the tilt angle of the blade. Forward tilt of the vertical mast may also be used when lowering the plow blade into the ground to protect the cable chute from damage, whereby the chute is tilted away from the ground during entry of the blade. Further, the attack angle of the blade may be varied to compensate for varying soil conditions. And, the depth of the cut of the blade may be varied by lift cylinders 102, without requiring repositioning of the blade with respect to the plow support assembly.

The blade may be caused to track laterally by operation of control mechanism 28. As described, a cable-laying plow is normally rigidly mounted in the longitudinal axis of the prime mover or vehicle 22, however it may be most desirable to move the plow laterally, at times during operation of the cable-laying plow. The disclosed embodiment permits remote operation and control of the lateral position of the blade. The blade may be turned by actuation of pistons 162, best shown in FIGS. 2 and 4.

Extension of one piston rod 166 and retraction of the other causes the frame assembly 30 to pivot about vertical pivot 124, turning the blade 32 relative to the longitudinal axis of the prime mover. The blade may thereby be caused to track the prime mover or follow a separate path by simultaneous action of cylinder 144. As described above, slide frame assembly 118 is slidably supported on plate 116, which plate forms part of the relatively fixed frame assembly supported on the mast assembly 26. Actuation of piston 144 results in lateral motion of slide frame assembly 118 and therefore blade 32. The blade may be shifted laterally, relative to the longitudinal axis of the prime mover 22, prior to entry of the blade in the soil or the blade may be caused to track laterally by simultaneous operation of pistons 162 and 144 while the plow is in the soil and during continuous operation.

As described above, the unique suspension of the blade 32 and vibrator 220 results in an orbital or arcuate motion of the blade toe 33, as shown in FIGS. 6 to 10. The vibrator 220 is suspended on a U-shaped yoke 222 which is pivotally supported on the blade support assembly 30. The blade 32 is pivotally and resiliently supported on the frame assembly and the yoke 22 is pivotally supported to the blade by link 242. This four-bar assembly results in orbital motion of the blade upon actuation of the vibrator or shaker 222.

It will be understood that various modifications may be made to the disclosed vibrator cable-laying plow, particularly in regard to the structural details which have been described herein by way of example. The unique cable-laying plow assembly may be used to remotely tilt, angle, laterally shift, raise and lower the blade assembly and results in an improved orbital motion of the blade. Various modifications of the disclosed assembly may therefore be made to achieve these various purposes and the systems may be utilized independently for the advantages stated.

We claim:

1. A vibratory plow, including a vehicle, a frame assembly operably supported on said vehicle and a generally vertical blade supported on said frame assembly, the improvement comprising:

a U-shaped yoke pivotally supported at opposite ends on said frame assembly having a free center portion, a vibrator supported on said yoke center portion generally in the plane of said blade and said yoke center portion pivotally connected to said blade by a link, said yoke transmitting the vibrations generated by said vibrator to said blade and vibrating said blade in an orbital motion.

2. The vibratory plow defined in claim 1, characterized in that said blade is pivotally mounted on said frame assembly with the pivotal connection including a resilient elastomertic bearing element permitting limited pivotal motion of said blade.

3. The vibratory plow defined in claim 2, characterized by said link being pivotally connected adjacent one end to said yoke and pivotally connected adjacent the opposed end to said blade.

4. The vibratory plow defined in Claim 3, characterized that the pivotal connections of said link each include a transverse pivot pin and an annular elastomertic element surrounding said pin and between the interconnected elements.

5. The vibratory plow defined in claim 1, characterized in that said yoke reduces a generally flat inclined center portion and said vibrator being mounted upon said mid-portion.

6. The vibratory plow defined in claim 5, characterized in that said yoke is pivotally connected to said blade by a link, said link being pivotally connected adjacent one end to said yoke, beneath said vibrator and said link being pivotally connected to said blade adjacent its opposed end.

7. The vibratory plow defined in claim 6, characterized in that said blade is pivotally mounted on said frame assembly with the pivotal connection including an elastomeric torque cushioning element.

8. A vibratory plow, including a vehicle, a frame assembly operably connected to and supported by said vehicle, a generally vertical blade and a vibrator operably connected to said blade, the improvement comprising:

said blade pivotally connected to said frame assembly, the pivotal connection between said blade and said frame including an elastomeric torque cushioning element between said blade and said frame, a U-shaped yoke pivotally connected adjacent its opposed ends to said frame having an unsupported mid-portion and said vibrator supported on said yoke mid-portion generally in the plane of said blade, a link pivotally connected adjacent one end to said yoke mid-portion and said link pivotally connected adjacent the opposed end to said blade, spaced from said pivotal connection of the blade to said frame, said link thereby transmitting the vibration of said vibrator to said blade and generating an arcuate cleaving motion in said blade.

9. The vibratory plow defined in claim 8, characterized in that each of the pivotal connections of said link include an elastomeric resilient element located between the link and the connected element.

10. The vibratory plow defined in claim 8, characterized in that said frame assembly includes a horizontal beam located between said blade and said vibrator, a motor supported on said beam operably connected to said vibrator and driving said vibrator and a vertical plate supported on said beam and pivotally connected to said blade.

11. The vibratory plow defined in claim 8, characterized in that said link being pivotally connected to said yoke, beneath said vibrator and the pivotal connections of said link each including an elastomeric resilient element located between said link and the connected element.

12. A vibratory cable laying plow for laying cable, pipe and the like undergound, including a vehicle, a plow having a generally vertical elongated blade supported on a frame, a cable guide supported on the trailing edge of said blade and a vibrator supported on said frame, vibrating said blade, the improvement comprising:

said plow pivotally supported on said blade with the pivotal connection including a resilient elastomeric bearing element between said blade and said frame permitting limited pivotal motion of said blade, a generally U-shaped yoke pivotally connected to said frame adjacent the opposed ends of said U-shaped yoke, said yoke having a free mid-portion inclined to the plane of said blade, said vibrator mounted on said inclined mid-portion of said yoke and said yoke pivotally connected to said plow transmitting an arcuate vibratory cutting motion to said blade.

13. The cable laying plow defined in claim 12, characterized in that said yoke is connected to said plow by a link, said link being pivotally connected adjacent one end to said yoke, beneath said vibrator, and said link being pivotally connected adjacent its opposed end to said plow blade.

14. The vibratory cable laying plow defined in claim 13, characterized in that each of the pivotal connections of said link include an elastomeric resilient bearing element between said link and the connected element.

* * * * *